United States Patent [19]

Sayler et al.

[11] Patent Number: 4,749,133

[45] Date of Patent: Jun. 7, 1988

[54] APPARATUS FOR THE PULVERIZATION AND BURNING OF SOLID FUELS

[75] Inventors: William H. Sayler, Salt Lake County; Justin C. White, Magna County, both of Utah

[73] Assignee: T.A.S., Inc., Magna, Utah

[21] Appl. No.: 482,503

[22] Filed: Apr. 6, 1983

Related U.S. Application Data

[63] Continuation-in-part of Ser. No. 304,860, Sep. 23, 1981, abandoned.

[51] Int. Cl.[4] ..... B02C 23/38

[52] U.S. Cl. ..... 241/56; 110/106; 241/57; 241/80; 241/152 A; 241/275; 241/284

[58] Field of Search ..... 110/347, 106; 241/55, 241/56, 57, 61, 152 A, 5, 26, 39, 8 D, 284, 275, 282.1, 152 R, 282.2, 58, 40

[56] References Cited

U.S. PATENT DOCUMENTS 1,541,903 6/1925 Crites ..... 110/106

2,561,388 7/1951 Lykken et al. ..... 241/56

OTHER PUBLICATIONS

"Raymond Vertical Mill", Bulletin No. 118, Combustion Engineering, Inc.

*Primary Examiner*—Mark Rosenbaum

*Attorney, Agent, or Firm*—Mallinckrodt & Mallinckrodt

[57] ABSTRACT

Apparatus and method for the pulverization and burning of solid fuels, such as coal, that provides for introducing relatively coarsely divided solid fuel into the lower part of an upstanding, closed housing for impact crushing therein, and for carrying the fuel fines upwardly through a turbulent zone defined in the housing between rotating spiders that include widely spaced radial blades that are oppositely angled to generate opposing air flows to further pulverize the entrained fuel fines autogenously by attrition. The entrained fuel fines in the rising column of air are then discharged from the housing into a burner for the pulverized solid fuel.

7 Claims, 2 Drawing Sheets

APPARATUS FOR THE PULVERIZATION AND BURNING OF SOLID FUELS

RELATED APPLICATION

This application is a continuation-in-part of application Ser. No. 304,860, filed Sept. 23, 1981, now abandoned.

BACKGROUND OF THE INVENTION

1. Field

The invention is concerned with the pulverization and burning of solid fuels, such as coal, and with apparatus for accomplishing same.

2. State of the Art

Burning of pulverized coal in industrial burners has long been practiced. Initially, it was necessary to provide a dryer for the coal, a crusher, a grinder classifier, and storage for the coal as pulverized by the grinder. The classifier was required to separate oversize particles and return them to the grinder for pulverization. The pulverized coal was fed to the burner from storage.

The crushers used for the purpose were adapted from known types for disintegrating metallic ores in the extractive metallurgical industry and were complicated, high in cost, high in horsepower requirements, and were not able to operate under low load conditions, thereby requiring storage of the pulverized coal rather than direct feeding of the burner.

Later, smaller pulverizers were developed and are presently used to directly fire burners through duct systems by means of carrier streams of air. Oversize particles are returned to the pulverizer for further size reduction. To insure proper operation, it is necessary to either feed dry coal into the pulverizer or to dry wet or damp coal in the pulverizer by injecting hot air thereinto, which introduces additional structural and maintenance expenses and operative complications in that the system does not handle load changes very well.

Pulverization by attrition has been employed to a limited extent, but has required a source of considerable quantities of compressed air or steam at excessive expense.

SUMMARY OF THE INVENTION

According to the invention, apparatus for pulverizing solid fuel materials, such as coal, is designed to be an integral part of a burner system. The material is pulverized and immediately entrained in an air stream for transport to the burner. It can be fed to the apparatus in wet or damp condition, which is a great advantage over known systems for firing burners with pulverized coal.

The apparatus of the invention comprises an upstanding, closed housing having an upstanding shaft therein mounted for rotation. An electric motor or other motive means is provided for rotating the shaft. Secured to the shaft adjacent to the bottom of the housing are one or more slingers for receiving relatively coarsely divided, solid fuel dropped thereon and for slinging it against the wall of the housing to disintegrate it by impact. Means are provided for establishing a flow of air upwardly within the housing to carry relatively finely divided particles of the solid fuel upwardly within and then out of the housing. Such means preferably includes a fan rotor secured to the shaft adjacent to the top of the housing for drawing air upwardly through an annular opening in the bottom portion of the housing, closely encircling the shaft so entering air will be thoroughly disseminated throughout the feed solids by action of the slinger, and discharging such air and pulverized fuel entrained therein from the housing. The entering air will thereby pick up small particles from the feed solids and carry them upwardly while large pieces and particles of the feed solids are slung outwardly for impact crushing. To provide for autogenous grinding of the rising column of air and solid particles by attrition, the interior of the housing between slinger and fan is relatively long and open. A substantially free and unencumbered space is thereby provided wherein air-turbulating means in the form of at least one pair of spaced-apart, air-activating spiders secured to the shaft is arranged intermediate the height of the housing. Air turbulence throughout the open interior of the housing is established by action of the rotating spiders in the housing on the rising column of air and solid particles, thereby, promoting autogenous grinding of the impact-disintegrated fuel particles. A collar plate above the spider directs air and entrained particle flow toward the center of the housing for entry into and passage through the fan rotor.

That portion of the housing surrounding the fan rotor preferably curves substantially tangentialy outwardly on one side to form the outlet for the air-fuel mixture, so that the larger particles therein will be forced to the outside of the housing for gravity separation from the finer particle and for recycling to the bottom of the housing.

In use, a conduit advantageously connects the outlet of the housing to a burner for feeding the air-fuel mixture directly to the burner. A return to the housing from such conduit may be provided, so that a portion of the air-fuel mixture is returned for recirculation when it is not required by the burner, as, for example, when the burner is operating at a low-heat setting. In this way, high velocity flow is maintained in the housing and in the conduit so that the fuel particles remain entrained in the air stream rather than settling out.

THE DRAWINGS

In the accompanying drawings, which illustrate the best mode presently contemplated of carrying out the invention:

FIG. 1 is an axial vertical section taken through pulverizing apparatus of the invention shown here as schematically coupled to a pulverized fuel burner;

FIG. 2, a fragmentary horizontal section taken along the line 2—2 of FIG. 1;

FIG. 3, a fragmentary vertical section taken along the line 3—3 of FIG. 2;

FIG. 4, a horizontal section taken along the line 4—4 of FIG. 1;

FIG. 5, a fragmentary vertical section taken along the line 5—5 of FIG. 4;

FIG. 6, a horizontal section taken along the line 6—6 of FIG. 1; and FIG. 7, a fragmentary vertical section taken along the line 7—7 of FIG. 6.

DETAILED DESCRIPTION OF THE ILLUSTRATED EMBODIMENT

Figure 1:
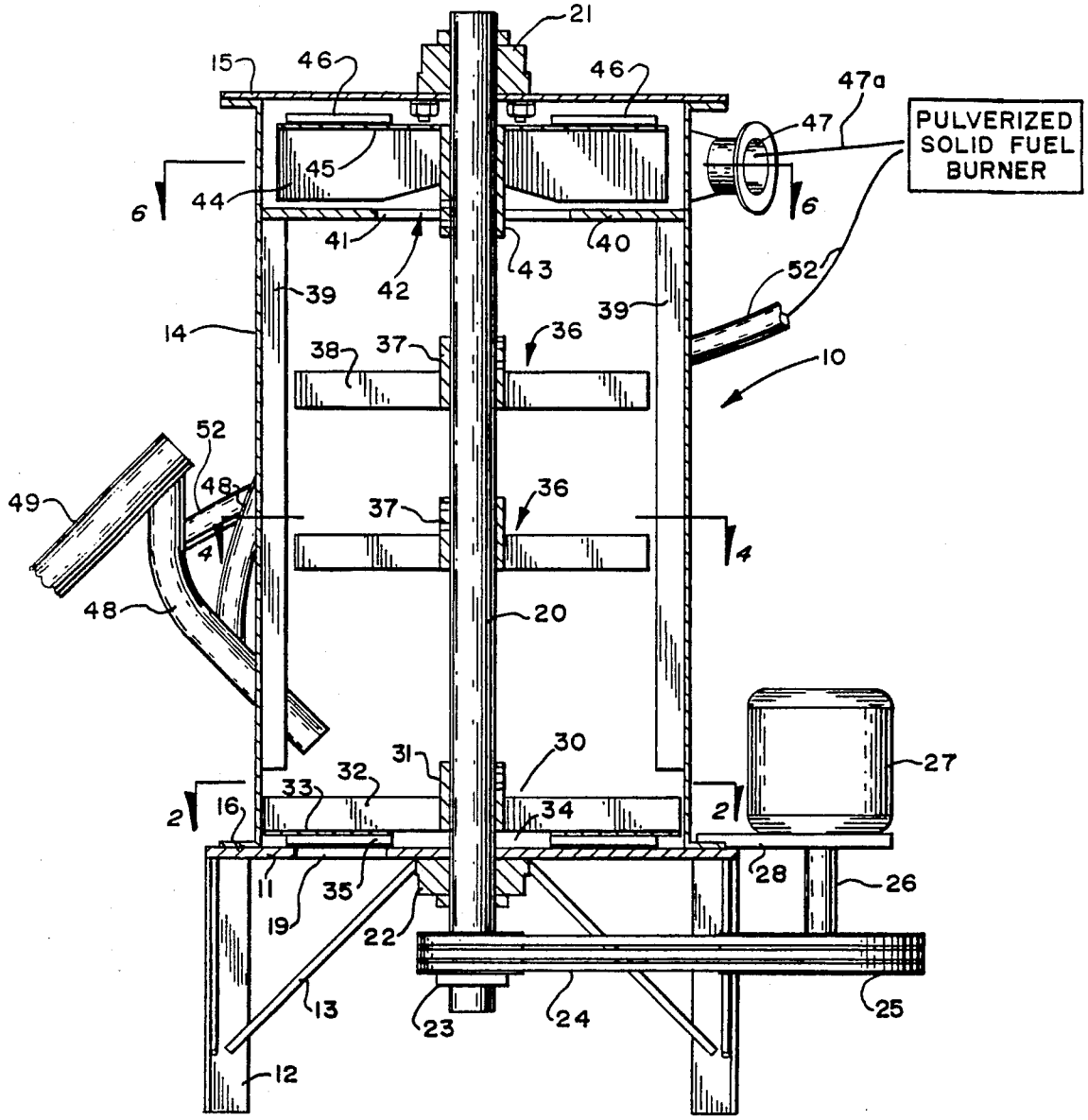
Figure 2:
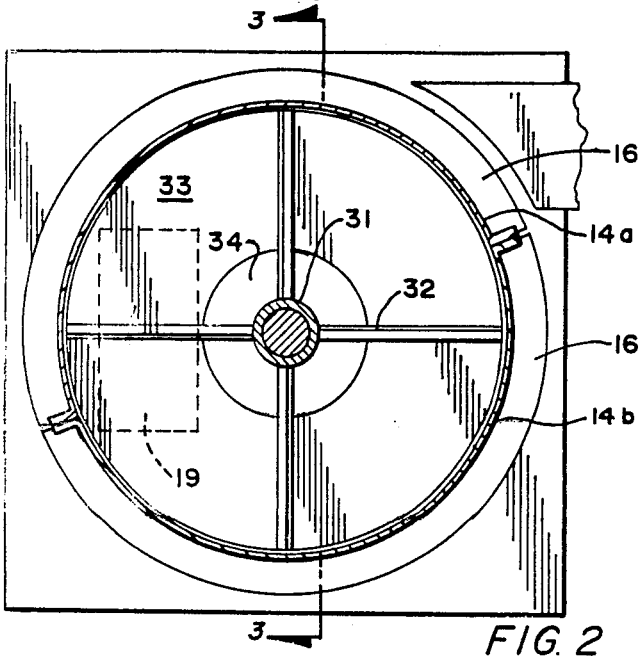

As illustrated in FIG. 1, the pulverizing apparatus of the invention includes an upstanding, cylindrical housing, designated generally as 10, which has a base plate 11 serving as its bottom and is supported by legs 12 shown as angle irons. Legs 12 may be secured to base plate 11 by welding and may be provided with braces 13 for added stability. Housing 10 also has an upstanding cylindrical wall 14 mounted on base plate 11 and supporting a top plate 15, which covers and closes the upper end of the housing. For ease of assembly and disassembly, cylindrical wall 14 may be provided with a circumferential flange 16 at its bottom, bolted to base plate 11, and a similar flange 17 at its top to which top plate 15 is bolted. It is preferred that cylindrical wall 14 be made in two semi-cylindrical half sections **14*a* and 14*b*, FIGS. 2, 4, and 6, so that one section can be removed without complete disassembly of the unit when access to the inside of the housing is necessary. For this purpose, outwardly extending flanges 18 are provided along the height of the joining edges of the two housing sections, so that such sections 14*a* and 14*b*** may be easily bolted together.

An air inlet opening 19 is provided preferably in base plate 11, and a pulverized fuel outlet is provided at an upper level of the housing as will be described in detail hereinafter.

A shaft 20 is mounted for rotation axially of the housing in bearings 21 and 22 secured to top plate 15 and base plate 11, respectively. The lower end of shaft 20 projects below bearing 22 and has secured thereon a pulley 23. Belts 24 connect pulley 23 with a drive pulley 25 on the power output shaft 26 of a motor 27. The motor is advantageously mounted on a cantilever platform 28 attached to housing 11.

Secured to a lower end portion of shaft 20 inside housing 10, so as to be positioned immediately above base plate 11, is a slinger 30, which includes a hub 31 encircling and keyed to shaft 20. Slinger 30 comprises radial vanes 32, to the bottom edges of which is secured a preferably flat, annular plate 33, leaving an annular open space 34 about hub 31. Relatively short vanes 35 are secured to the bottom of slinger plate 33 in radial orientation so as to project downwardly preferably directly opposite to upwardly projecting vanes 32. Such vanes 35 preferably terminate short of the outer edge of slinger plate 33 in their radial extension across the width of such slinger plate, as illustrated.

In this illustrated embodiment, air-turbulating means in the form of a pair of spiders 36 are secured in mutually spaced relationship to shaft 20 intermediate its height so as to be positioned more or less centrally in housing 10 within and intermediate the height of the relatively long and substantially free and unencumbered space above slinger plate 33. The spider vanes 38 are oppositely angled from the vertical on the respective spiders 36 of the pair to act as opposing axial fans, the lower one to force air and entrained solids upwardly through the spaces between the vanes and the upper one to similarly force air and entrained solids downwardly, so as to break up the vertical flow established in the housing by rotation of slinger 30 pulling air through annular opening 34 and disseminating it through the solid particle feed. Such air will pick up small solid particles and carry them into the open air-turbulating area while the larger pieces and particles of the feed solids are slung against wall 14 for impact crushing. Rotation of the two spiders with their opposing vanes provides a zone of high turbulation wherein particle attrition i.e. autogenous grinding occurs until all particles are fine enough to escape from that zone by entrainment in the air traveling upwardly through the housing. An angle of seven degrees to the vertical has been found satisfactory. However, variations in performance can be achieved by changes in this angle. A greater angle tends to provide greater turbulence and finer grinding. Thus, the angle to the vertical of the vanes can be slight or relatively great, effective results being achieved within the range of from about one degree to about forty-five degrees. Selection of a particular angle will depend upon the degree of fineness desired. With an angle of seven degrees, a particulate size was attained with a typical bituminous coal such that approximately seventy-eight percent of the grind passed through a 325 Microfine mesh sieve. In all instances, the selected vane angle should be such as will still permit a generalized upward flow of air and entrained solids substantially throughout this cross-sectional area of the housing by reason of the operation of fan rotor 42, the zone of intense turbulence being located between the spiders 36.

Figure 4:
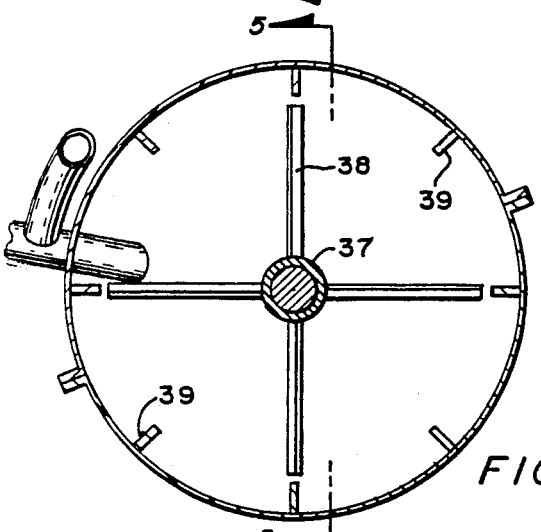
Figure 5:
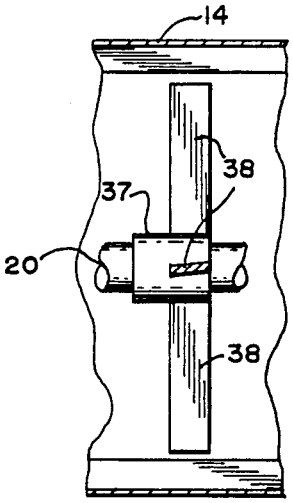

In the illustrated embodiment, each spider comprises a central hub 37 keyed to shaft 20, with four vanes 38 extending outwardly symmetrically from securement to that hub and terminating somewhat short of cylindrical wall 14, FIGS. 1, 4, and 5. It should be noted that vanes 38 are relatively widely spaced for turbulating the column of air rising within housing 10, substantially throughout the cross-sectional area thereof.

Additional turbulence is provided within housing 10 by the provision of upstanding ribs 39, here shown as four in number, secured, as by welding, at intervals to the inside face of wall 14 and extending inwardly of the housing to just short of the paths of travel of the tips of respective sets of vanes 38. Ribs 39 also provide additional impact surfaces for the particles of solid fuel and break up air circulation about wall 14.

Spaced from top plate 15 of the housing and secured to the inside face of cylindrical wall 14 is an annular collar plate 40, which defines a central opening 41. A fan rotor 42 is secured by a hub 43 to shaft 20 between collar plate 40 and housing top plate 15, and has fan blades 44 extending therefrom so as to comprehend almost the entire transverse cross-section of the housing. An imperforate disc 45 is secured to the top of and interconnects the blades 44, and relatively short vanes 46 are secured to and project upwardly from the top of disc 45. It can be seen that collar plate 40 and top plate 15 form a separate housing section for fan rotor 42 within the upper end of housing 10. Opening 41 provides input to the fan rotor of air-entrained, pulverized, solid fuel from the pulverizing section of housing 10 therebelow.

Figure 6:
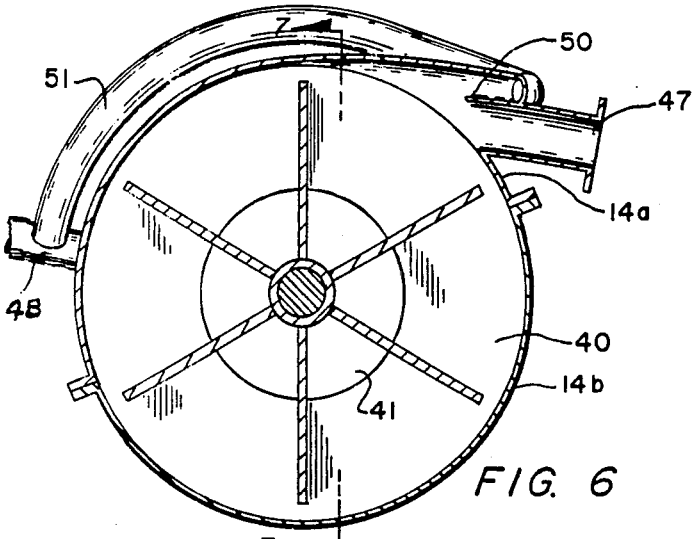
Figure 7:
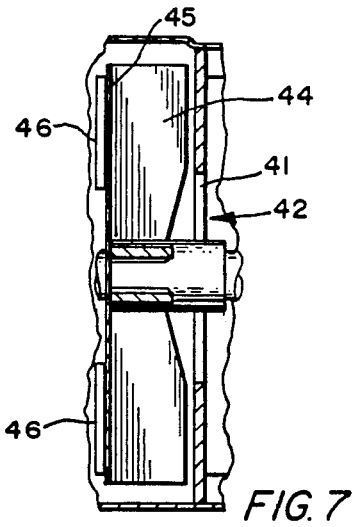

As shown in FIG. 6, a portion of cylindrical wall 14 surrounding fan rotor 42 is directed outwardly on one side to form an outlet 47, which is connected by a conduit **47*a*, see FIG. 1**, to a pulverized-solid-fuel burner of selected type.

A feed conduit 48 for the solid fuel to be pulverized is provided through wall 14 of housing 10 so as to discharge preferably immediately above annular slinger plate 33. Any means of supplying solid fuel to the feed conduit 48 may be provided, e.g. a screw conveyor 49 which is preferred because it has been found, in accordance with one aspect of the invention, that if a screw conveyor is positioned so as to slope upwardly with respect to the conduit into which it discharges, here the conduit 48, as illustrated in FIG. 1, the fuel packs better, giving a more even feed and making for better performance of the entire apparatus.

In the illustrated embodiment, which is designed particularly for handling bituminous coal, fragments of relatively coarse-sized coal, e.g. lumps up to a size of two inches, are fed into the apparatus through conduit 48 while shaft 20 is being rotated by motor 27. The fragments of coal fall into slinger 30, and the slinger vanes 32 intercept their fall, breaking some of them through impact and slinging at least part of any remaining fragments and broken pieces outwardly with great force against inner surface of cylindrical wall 14 of the housing. The feed fragments are broken, and the broken pieces tend to be further broken by repeated impacts against such housing wall. Meanwhile, upward flow of air in housing 10 is provided by fan rotor 42 drawing air through inlet opening 19 an annular opening 34 in base plate 11 closely encircling shaft 20. Such opening 19 can be supplemented by one or more additional inlet openings in either the housing bottom or side. Air and coal particles entrained therein pass as a rising column into the autogenous pulverizing zone between spiders 36, wherein the coal particles are circulated and further pulverized by attrition. There is a generalized upward flow of the turbulent column, whereby the finely pulverized coal particles are carried upwardly and out through outlet 47 and into the burner through conduit 47*a*.

As the fed fragments of coal fall into slinger 30 from conduit 48 and heavier broken pieces fall back into the slinger from above, most will be directed over annular slinger plate 33 because of the air flow upwardly through opening 34 and the action of slinger means 32. However, air drawn upwardly through opening 19 will come under the influence of the relatively short vanes 35 and be forced outwardly to produce a high velocity air flow along the bottom and about the periphery of slinger 30 sufficient to carry crushed coal upwardly near wall 14. Any coal which does fall through opening 34 will be caught by the outward air flow below slinger plate 33 and slung against wall 14 by vanes 35 for impact pulverization. As previously indicated, heavier coal particles will fall back into slinger 30 from the column of air rising throughout the housing interior, while lighter particles will travel upwardly with such column of air.

Figure 3:
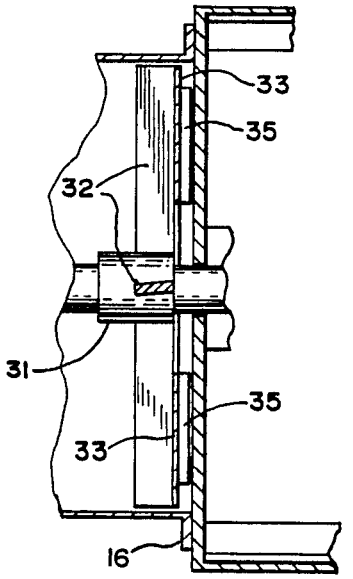

It will be noted that it is preferable to angle slinger vanes 32 slightly as shown in FIG. 3 so as to cause a generally upward motion of the air and solid fuel material along the length of the arms. This has been found to improve the pulverizing operation of the apparatus in that the coal fragments are flung upwardly and outwardly radially by the angled slinger vanes into the housing open area, impacting against each other and the housing wall.

As previously indicated, intense air turbulence between the spiders 36, with freedom for circulation, causes the particles of coal to hit against each other and thus grind themselves by attrition to even smaller sizes. This is autogenous grinding.

Outlet 47 preferably extends in a somewhat curved, tangential manner from housing 14 and into the burner through the outflow conduit 47*a*. Larger particles in the air stream are forced toward wall 14 and its continuation into outlet 47. A scalper 50 is advantageously located alongside outlet 47 to catch such larger particles and return them, along with excess air, through scalper conduit 51, FIG. 6, to inlet 48 for further size reduction. The relatively short vanes 46 on top of fan disc 45 prevent buildup of fuel particles above the fan rotor and thus protect bearing 21.

The burner is preferably as described in our copending application for patent Ser. No. 378,347, filed May 14, 1982, and entitled "Solid Fuel Pulverizing and Burning System and Method and Pulverizer and Burner Therefor", now abandoned. The amount of air supplied to housing 10 and the velocity of the air stream are determined by the size of air inlet 19 and the size and speed of rotation of fan rotor 42. The amount of pulverized fuel carried by the air stream is largely controlled by the fuel feed rate to the pulverizing apparatus, which apparatus operates best when such rate is high.

In most burners of pulverized solid fuel, including the one described in our above-referenced patent application, the flow rate of air-fuel mixture into the burner may be varied in known manner to vary the flame intensity and heat output. To this end, a return conduit, indicated schematically at 52, FIG. 1, may be provided from any selected point along outlet 47 and conduit 47*a* to lead back to the fuel input of the pulverizing apparatus. This arrangement makes it possible to maintain a more or less constant air-fuel flow rate through the pulverizing apparatus for optimum pulverizing performance and through the outlet and the conduit to the burner such that the entrained fuel particles are prevented from settling out of the air stream. Additionally, this recirculation increases the particulate concentration in the housing, resulting in increased pulverizing efficiency within the turbulent areas wherein pulverization by attrition takes place.

A very wide variation in flow rates is made possible by changing the size of air inlet opening 19, as by inclusion of a damper (not shown) or by adding additional inlets, bearing in mind that the coal input rate must be also varied appropriately. So arranged, there may often be no need for recirculation between the burner and the pulverizing apparatus, since the latter can supply a suitable coal-air stream to the burner over a wide range of burner settings. Such settings can, for example, be over a burner "turn down" ratio of 15:1, in which the high-heat setting requires a coal-air supply fifteen times greater than the low-heat setting.

Wear plates or hard linings may be secured in the housing at points of heavy wear, such as about the slinger.

The pulverizing apparatus of the invention may be made in various sizes to suit the needs of the burner with which it is to be used. Its grinding capacity varies in accordance with internal volume, the rate of inflow of fuel, spider vane angles, and speed of rotation of shaft 20. In practice, the spider vane angles to the vertical are adjusted to produce the desired final grind of the fuel particles.

Typical sizes for the apparatus will be based on inside diameter of the cylindrical housing 10, which will typically range from about eighteen inches to about thirty inches. However, size can vary greatly and can be much larger than indicated.

For the apparatus shown, with a housing diameter of eighteen inches and an air inflow opening eighteen square inches in area, the coal feed rate and, thus, the coal throughput can vary between about one pound per minute and about fifteen pounds per minute. The corresponding air flow through the apparatus will vary between about one hundred thirty three cubic feet per minute and about sixteen hundred sixty seven cubic feet per minute. At maximum coal and air throughput, the apparatus operates at about twenty horsepower.

The speed of rotation of shaft 20 should be within the range of about 1500 to about 3000 RPM, depending upon the size of the machine and the solid fuel being processed. For the eighteen inch diameter housing, the optimum RPM at full speed will be between 2000 and 2600. As the diameter of the apparatus increases, using the same power, the speed of rotation will decrease. Thus, it will be seen that the spiders operate considerably more slowly than conventional whizzer separators as used in the Crites pulverizer mill of U.S. Pat. No. 2,561,564, issued July 24, 1951 for "Pulverizing Mill Separator, Having Whizzer and Directional Vanes." Surprisingly, this coupled with the open nature of such spiders and the angling thereof to the vertical, has produced exceptionally desirable results so far as rapid and fine pulverization and the handling of damp or wet material are concerned.

An unusual and highly advantageous feature of the invention is the ability of the apparatus to accept and effectively handle very wet material, even to the extent of near saturation. No one aspect of the structure appears to be critical in this connection; rather, it is believed to be the general combination of structural and operative features outlined above and set forth in the claims that is responsible for this important accomplishment. Thus, the feed material is first ground by impact and then by attrition. There are no metal-to-metal grinding surfaces, as in the usual grinders. Moreover, there is a column of air which rises within the housing and carries the finer particles upwardly and outwardly through an intermediate zone of intense turbulance. Therefore, concentration of moisture will not occur.

Although bituminous coal is the preferred solid fuel, the illustrated embodiment of the apparatus of the invention has operated successfully with lignite and with oil shale.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. Apparatus for pulverizing coarsely-divided, solid fuel, such as coal, and for feeding the pulverized fuel to a burner, comprising an upstanding housing having side, bottom and top walls; an upstanding shaft axially mounted for rotation within said housing; means for rotating the shaft; a slinger having an annular opening therethrough concentric with and closely encircling said shaft, said slinger being secured to the shaft at the bottom of the housing, being peripherally spaced from the housing side walls, and being constructed to catch coarsely divided solid fuel that is fed to the housing and to sling it outwardly to impact against the interior wall surface of the housing so as to disintegrate said solid fuel; fan means secured to the shaft immediately below the top wall of the housing; air-turbulating means comprising a pair of spiders, each including a hub secured to said shaft within the interior of the housing, from which hub extend a plurality of relatively widely spaced apart radial vanes, the vanes on one hub being angled from the vertical oppositely to the vanes of the other hub for creating intense turbulence and size attrition of solid fuel particles in the zone between the spiders of the pair as air and solid fuel particles flow upwardly therethrough under the influence of said fan means, said interior of the housing between the slinger and the fan means being long relative to width and being substantially open around said shaft and throughout for upward turbulent flow of air and solid fuel particles; air-inlet means in the housing below said slinger so that air will flow upwardly through said annular opening as well as peripherally of the slinger, entraining fine solid fuel particles during passage through said housing interior for further pulverization by size attrition between said spiders; outlet means provided through the side wall of the housing adjacent to said fan means, said outlet means being adapted for connection with said burner; and solid fuel input means leading into the housing and positioned to feed coarsely-divided solid fuel onto said slinger.

2. Apparatus according to claim 1, wherein the angle from the vertical of the vanes of each spider is within the range of one degree to forty-five degrees, dependent upon the fineness of the grind of the fuel particles desired.

3. Apparatus according to claim 1, wherein a collar plate is interposed between the spiders and the fan means to provide a restricted passage immediately surrounding the shaft for passage of air and entrained fuel particles into the fan means.

4. Apparatus according to claim 1, wherein the housing is cylindrical; wherein the fan means is a fan rotor having blades extending across the housing; the outlet means is formed by a portion of the housing opposite the fan rotor which extends substantially tangentially outwardly so that larger particles will be forced to the outside; and wherein means are provided to recycle the outer portion of the outflowing stream, which contains the larger particles, back into the apparatus.

5. Apparatus according to claim 1, wherein the solid fuel input means comprises an upwardly angled screw conveyor feeding into a downwardly angled, gravity feed conduit.

6. Apparatus according to claim 1, including a burner for pulverized solid fuel; conduit means connecting the outlet means to the burner; and means adjacent to the burner to recirculate a portion of the stream inflowing to the burner back to the pulverizing apparatus, so that the flow rate in said conduit means remains high regardless of the amount of fuel-air mixture actually passed into the burner.

7. Apparatus for pulverizing coarsely-divided, solid fuel, such as coal, and for feeding the pulverized fuel to a burner, comprising an upstanding housing having side, bottom and top walls; an upstanding shaft mounted for rotation within said housing; means for rotating the shaft; a slinger secured to the shaft at the bottom of the housing, said slinger being open around said shaft for the passage of a column of air upwardly around said shaft and being otherwise constructed to catch coarsely-divided solid fuel that is fed to the housing and to sling it outwardly to impact against the interior wall surface of the housing so as to disintegrate said solid fuel; fan means secured to the shaft immediately below the top wall of the housing; air-inlet means in the bottom wall of the housing communicating with said slinger opening; outlet means provided through the side wall of the housing at about the level of said fan means, said outlet means being adapted for connection with said burner; air-turbulating means comprising relatively widely spaced vanes secured to said shaft within said interior of the housing for creating turbulence and attrition of solid fuel particles throughout said interior of the housing as air and solid fuel particles flow upwardly therethrough under the influence of said fan means, said interior of the housing between the slinger and the fan means being long relative to width and being substantially open around said shaft and throughout for upward turbulent flow of air and solid fuel particles; and solid fuel input means leading into the housing and positioned to feed coarsely-divided solid fuel onto said slinger; there being lower and upper sets of vanes, the vanes of each set being angled to direct flow toward the other set of vanes.

* * * * *